US011292694B2

(12) United States Patent
Xiong

(10) Patent No.: US 11,292,694 B2
(45) Date of Patent: Apr. 5, 2022

(54) ELEVATOR GUIDE RAIL SUPPORT ASSEMBLIES

(71) Applicant: Otis Elevator Company, Farmington, CT (US)

(72) Inventor: Bi Xiong, Châtillon-sur-Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 181 days.

(21) Appl. No.: 16/590,659

(22) Filed: Oct. 2, 2019

(65) Prior Publication Data

US 2020/0115190 A1 Apr. 16, 2020

(30) Foreign Application Priority Data

Oct. 11, 2018 (EP) ..... 18306340

(51) Int. Cl.
*B66B 7/02* (2006.01)

(52) U.S. Cl.
CPC ..... *B66B 7/026* (2013.01); *B66B 7/02* (2013.01); *B66B 7/024* (2013.01)

(58) Field of Classification Search
CPC ..... B66B 7/023; B66B 7/024; B66B 7/026; E01B 11/28; E01B 11/30; E01B 11/32; E01B 11/58
See application file for complete search history.

(56) References Cited

U.S. PATENT DOCUMENTS

| | | | | | |
|---|---|---|---|---|---|
| 838,101 | A * | 12/1906 | Gilges | E01B 11/32 | 238/225 |
| 1,455,695 | A * | 5/1923 | Woll | E01B 11/10 | 238/205 |
| 1,547,952 | A * | 7/1925 | O'Neill | E01B 11/58 | 238/210 |
| 5,950,770 | A | 9/1999 | Koeppe, Jr. et al. | | |
| 6,371,249 | B1 | 4/2002 | Schops et al. | | |
| 10,040,666 | B2 | 8/2018 | Bjorni et al. | | |

FOREIGN PATENT DOCUMENTS

| | | | |
|---|---|---|---|
| CA | 2182134 | A1 | 4/1997 |
| CA | 2549278 | A1 | 11/2007 |
| CN | 1895982 | A | 1/2007 |
| CN | 1918062 | A | 2/2007 |
| CN | 101215810 | B | 7/2008 |
| CN | 102730515 | A | 10/2012 |

(Continued)

OTHER PUBLICATIONS

European Search Report for European Application No. 18306340.3, International Filing Date Oct. 11, 2018, dated Jun. 3, 2019, 7 pages.

*Primary Examiner* — Minh Truong
(74) *Attorney, Agent, or Firm* — Cantor Colburn LLP

(57) ABSTRACT

Guide rail support assemblies for elevator systems are provided. The guide rail support assemblies include a junction element comprising a backing plate, a first extension, and a second extension, the junction element defining a rail cavity, wherein the rail cavity is configured to receive two rail sections, wherein the junction element is configured to join a first rail section to a second rail section and a mounting element configured to attach to a wall of an elevator shaft, wherein the mounting element is connected to the junction element.

18 Claims, 11 Drawing Sheets

(56) References Cited

FOREIGN PATENT DOCUMENTS

| | | | | |
|---|---|---|---|---|
| CN | 204689302 | U | | 10/2015 |
| CN | 106219355 | A | | 12/2016 |
| CN | 106629322 | A | * | 5/2017 |
| CN | 106629323 | A | | 5/2017 |
| CN | 207258956 | U | | 4/2018 |
| CN | 112110314 | A | * | 12/2020 |
| EP | 0089461 | A2 | | 9/1983 |
| EP | 1693519 | B1 | | 8/2006 |
| EP | 1743863 | A1 | | 1/2007 |
| EP | 2646362 | B1 | | 10/2013 |
| EP | 3085655 | B1 | | 11/2017 |
| FR | 3045079 | A1 | | 6/2017 |
| JP | H054786 | A | | 1/1993 |
| JP | H10297842 | A | | 11/1998 |
| JP | 2008068961 | A | | 3/2008 |
| JP | 2012188175 | A | | 10/2012 |
| WO | 2005081734 | A2 | | 9/2005 |
| WO | 2010056766 | A1 | | 5/2010 |
| WO | 2013172296 | A1 | | 11/2013 |
| WO | 2015029182 | A1 | | 3/2015 |

* cited by examiner

ELEVATOR GUIDE RAIL SUPPORT ASSEMBLIES

CROSS REFERENCE TO RELATED APPLICATIONS

This application claims the benefit of European Application No. 18306340.3, filed Oct. 11, 2018, which is incorporated herein by reference in its entirety.

BACKGROUND

The subject matter disclosed herein generally relates to elevator systems and, more particularly, to guide rail section support assemblies and wall mounting of such guide rail sections.

Current elevator systems use one type of guide rail to form a guide rail upon which an elevator car and/or counterweight may travel. The guide rail is typically formed of different rail sections that are joined together. The rail sections may also be affixed to a wall of an elevator shaft. To achieve such joining and mounting, current systems use a junction fishplate to join and connect two adjacent rail sections. Further, at different locations, in order to reduce profiles and number of components, a wall mounting bracket is connected to the rail sections.

SUMMARY

According to some embodiments, guide rail support assemblies for elevator systems are provided. The guide rail support assemblies include a junction element comprising a backing plate, a first extension, and a second extension, the junction element defining a rail cavity, wherein the rail cavity is configured to receive two rail sections, wherein the junction element is configured to join a first rail section to a second rail section and a mounting element configured to attach to a wall of an elevator shaft, wherein the mounting element is connected to the junction element.

In addition to one or more of the features described above, or as an alternative, further embodiments may include a connector connecting the junction element to the mounting element.

In addition to one or more of the features described above, or as an alternative, further embodiments may include that the connector is adjustable to adjust a separation distance between the junction element and the mounting element.

In addition to one or more of the features described above, or as an alternative, further embodiments may include a stop, the stop positioned within the junction element and dividing the rail cavity into a first rail cavity and a second rail cavity, wherein the stop, the first extension, the second extension, and the backing plate define the respective first rail cavity and the second rail cavity.

In addition to one or more of the features described above, or as an alternative, further embodiments may include that the stop has a profile in a shape of a cross-section of a rail section.

In addition to one or more of the features described above, or as an alternative, further embodiments may include that the stop is part of the mounting element.

In addition to one or more of the features described above, or as an alternative, further embodiments may include that the backing plate of the junction element is formed from a first backing plate and a second backing plate, wherein each of the first backing plate and the second backing plate are attached to the mounting element.

In addition to one or more of the features described above, or as an alternative, further embodiments may include that the first extension is connected to the first backing plate and the second extension is connected to the second backing plate.

In addition to one or more of the features described above, or as an alternative, further embodiments may include that each of the first and second backing plates are connected to the mounting element.

In addition to one or more of the features described above, or as an alternative, further embodiments may include that the mounting element is connectable to a wall of an elevator shaft by at least one fastener.

According to some embodiments, elevator systems having a guide rail support assembly including one or more of the features described above are provided.

In addition to one or more of the features described above, or as an alternative, further embodiments may include a first rail section installed into the rail cavity and a second rail section installed into the rail cavity to form a portion of a guide rail.

In addition to one or more of the features described above, or as an alternative, further embodiments may include that a stop is positioned between the first rail section and the second rail section within the guide rail support assembly In addition to one or more of the features described above, or as an alternative, further embodiments may include that the guide rail is one of a guide rail for an elevator car and a guide rail for a counterweight.

In addition to one or more of the features described above, or as an alternative, further embodiments may include that the mounting element is fixedly attached to a wall of an elevator shaft.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
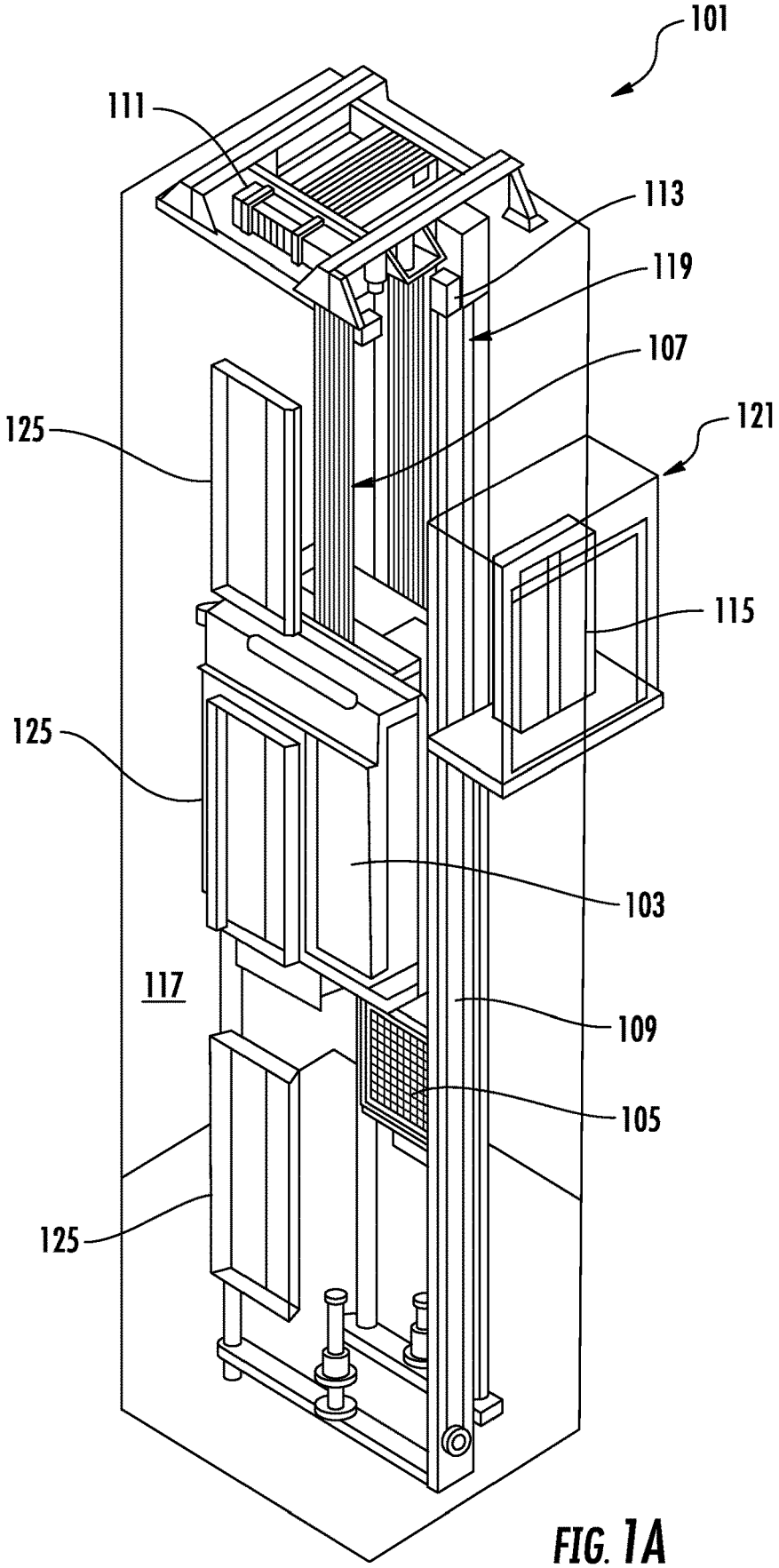
FIG. 1A is a schematic illustration of an elevator system that may employ various embodiments of the disclosure.

FIG. 1A is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system including roping 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1A is merely a non-limiting example presented for illustrative and explanatory purposes.

Figure 1B:
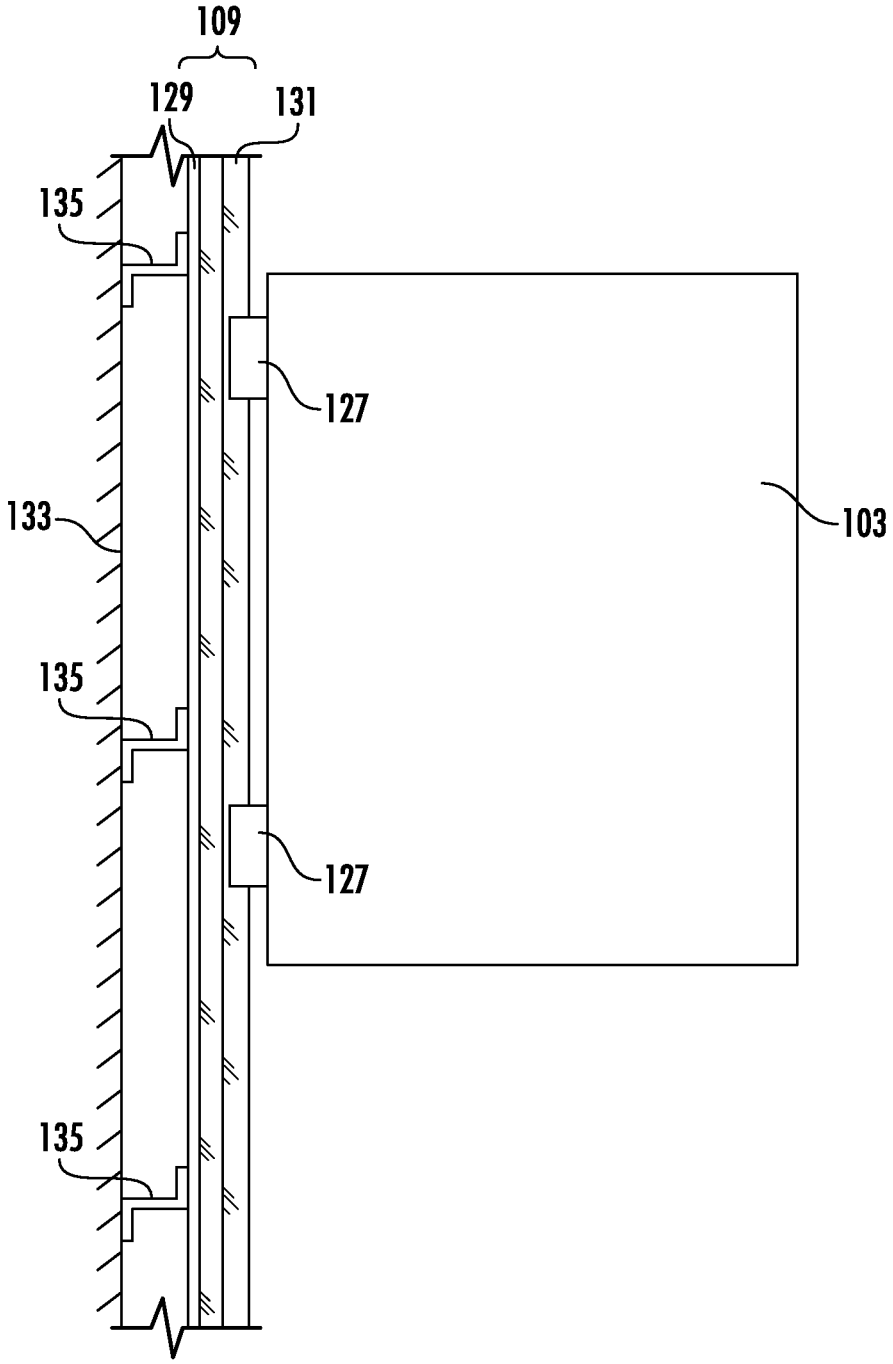
FIG. 1B is a side view schematic illustration of an elevator car of FIG. 1A attached to a guide rail track.

FIG. 1B is a side view schematic illustration of the elevator car 103 as operably connected to the guide rail 109. As shown, the elevator car 103 connects to the guide rail 109 by one or more guiding devices 127. The guiding devices 127 may be a guide shoe, a roller, etc. The guide rail 109 defines a guide rail track that has a base 129 and a blade 131 extending therefrom. The guiding devices 127 are configured to run along and/or engage with the blade 131. The guide rail 109 mounts to a wall 133 of the elevator shaft 117 by one or more brackets 135. The brackets 135 are configured to fixedly mount to the wall 133 and the base 129 of the guide rail 109 fixedly attaches to the brackets 135. As will be appreciated by those of skill in the art, a guide rail of a counterweight of an elevator system may be similarly configured.

In existing systems, the guide rail comprises a plurality of sections that are joined together to form the guide rail along which an elevator car may travel. To join the sections of rail together, a junction fishplate is fixed by steel nuts and screws to the two adjacent and connected rails, as will be appreciated by those of skill in the art. Further, the individual sections of the assembled guide rail may be affixed to a wall of the elevator shaft using brackets (e.g., brackets 135 shown in FIG. 1B). Installation of such systems may be time consuming and difficult due to each junction fishplate and bracket required to be installed separately within an elevator shaft. Further, such systems have minimum dimensions to provide structural support and engagement with the rail sections, and thus reductions in elevator shaft dimensions may be restricted. Further, during installation, the location of the brackets may interfere with the junction fishplates, and thus, depending on building requirements, modifications may be required.

Figure 2A:
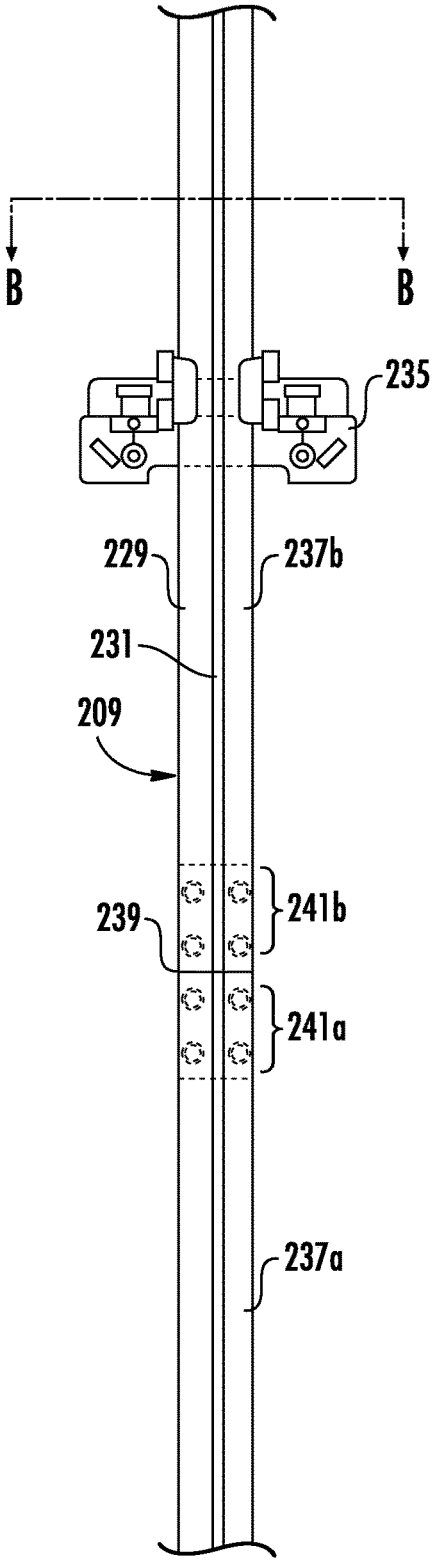
FIG. 2A PRIOR ART
FIG. 2A is a schematic illustration of a guide rail fixed to a wall by a bracket and multiple rail sections joined by a junction fishplate, in accordance with a typical arrangement.
Figure 2B:
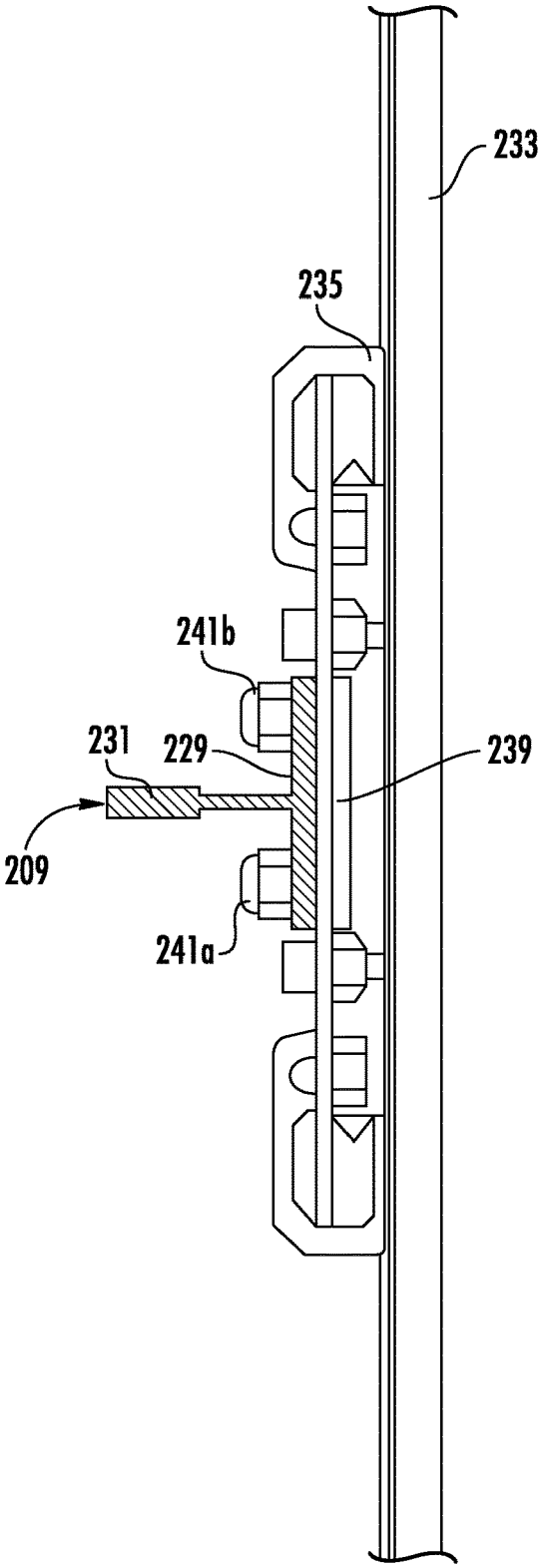
FIG. 2B PRIOR ART
FIG. 2B is a view of the guide rail of FIG. 2A as viewed along the line B-B of FIG. 2A.

For example, turning to FIGS. 2A-2B, an example traditional configuration for a guide rail 209 is illustratively shown. FIG. 2A is a front elevation view of the guide rail 209 and FIG. 2B is a top-down illustration of the guide rail 209 viewed along the line B-B shown in FIG. 2A. The guide rail 209 is supported by and mounted to an elevator shaft wall 233 by one or more brackets 235. The brackets 235 may wrap partially around a base 229 of the guide rail 209, with a blade 231 extending from the base 229. The guide rail 209 is formed from multiple rail sections 237*a*, 237*b*. The rail sections 237*a*, 237*b* are fixedly connected to each other with a junction fishplate 239. The junction fishplate 239 provides a support and connection between the rail sections 237*a*, 237*b*. The rail sections 237*a*, 237*b* are connected to the junction fishplate 239 by respective fasteners 241*a*, 241*b*. The fasteners 241*a*, 241*b* may be bolts or other similar elements, and as such occupy some amount of space (e.g., as shown in FIG. 2B). Because of this, the bracket 235 cannot be connected to the guide rail 209 at the same location as the junction fishplate 239.

FIG. 2B illustrates the guide rail 209 as viewed along the line B-B shown in FIG. 2A. As shown, the fasteners 241*a* (and the fasteners 241*b*) extend away from the wall 233, thus occupying additional volume within an elevator shaft. That is, the fasteners 241*a*, 241*b* extend into the elevator shaft in order to secure the rail sections 237*a*, 237*b* together to form the guide rail 209.

As provided herein, guide rail support assemblies are provided that incorporate both the function of a junction fishplate and a wall mount. The guide rail support assemblies of the present disclosure are composed of two parts. A first part is a rail engagement portion (e.g., a clamp) which has the form (cross-sectional shape) of the rail sections to receive rail sections. In some embodiments, the ends of rail sections may slide into the rail engagement portion and be secured therein without the use of screws or other securing mechanisms. In some embodiments, in the middle of the rail engagement portion there is a horizontal stop (e.g., small plate) to separate two joined rail sections. In some embodiments, the stop may have a similar shape or geometry as a cross-section of a rail section. A wall mount is attached to and configured to support the rail engagement portion. The wall mount can be varied in position or even extension into an elevator shaft (i.e., distance extending from wall) by a sliding system to adjust the gap with the wall. The wall mount can be fixed by screws, dowels, or other similar fasteners (e.g., same fixation as current guide rail brackets). During the field mounting, the guide rail support assemblies can be mounted above each lower rail section to make the junction between adjacent rail sections and can be directly fixed to the elevator shaft wall. As will be appreciated by those of skill in the art, embodiments described herein can be applied to counterweight guide rails, and the description and illustrations are merely for example and explanation.

Figure 3A:
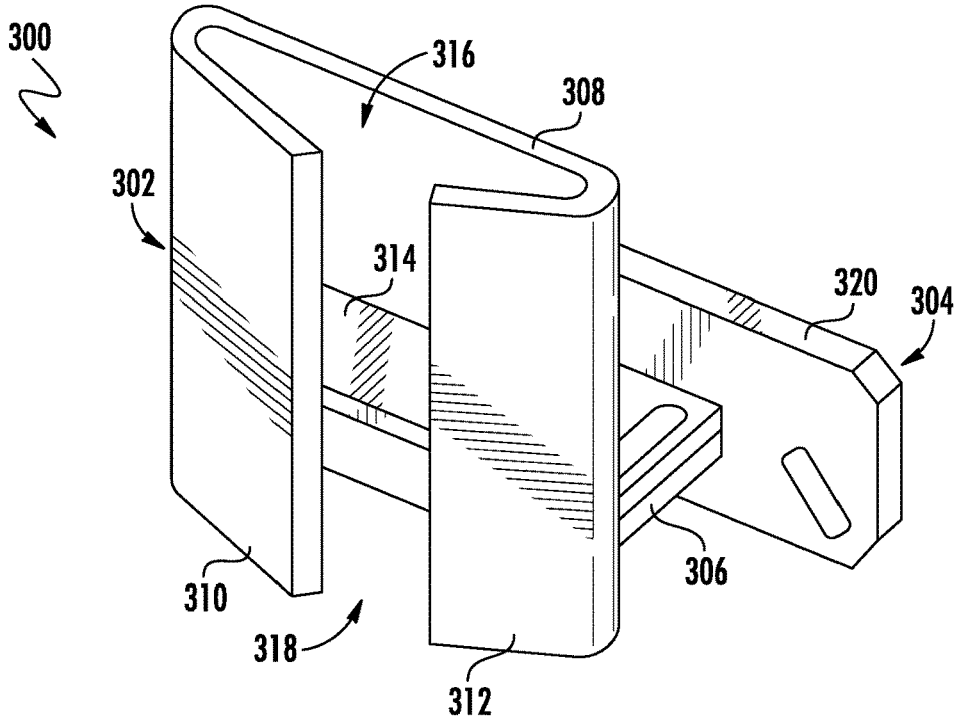
FIG. 3A is an isometric schematic illustration of a guide rail support assembly in accordance with an embodiment of the present disclosure.
Figure 3B:
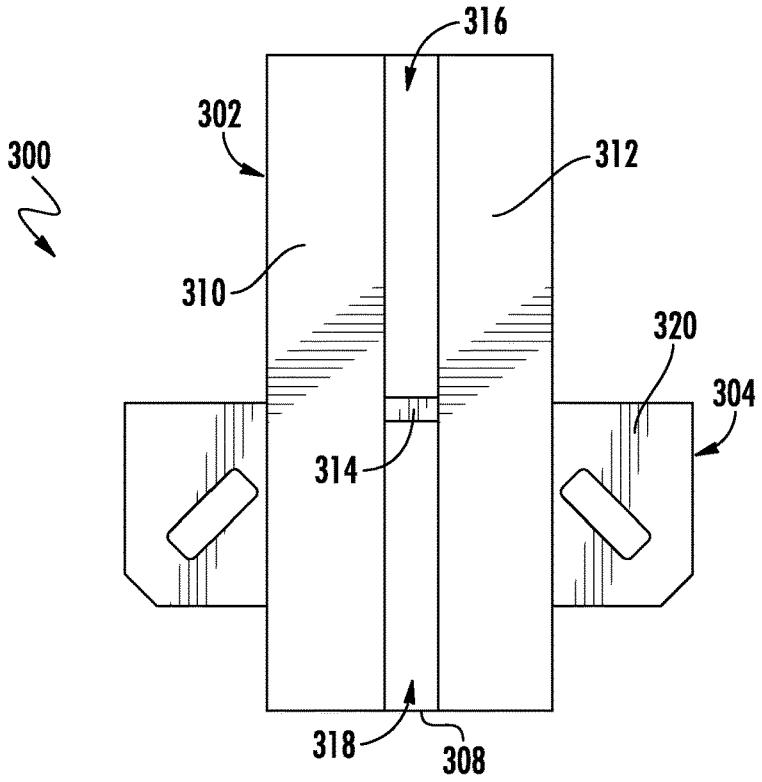
FIG. 3B is a front elevation illustration of the guide rail support assembly of FIG. 3A.

Turning now to FIGS. 3A-3B, schematic illustrations of a guide rail support assembly 300 in accordance with an embodiment of the present disclosure are shown. The guide rail support assembly 300 is configured to attach to a wall of an elevator shaft and receive sections of the guide rail to enable connection thereof to form a guide rail. That is, the guide rail support assembly 300 provides both junction fishplate functionality and wall bracket functionality, in a single, unitary structure or component. FIG. 3A is an isometric illustration of the guide rail support assembly 300 and FIG. 3B is a front elevation illustration of the guide rail support assembly 300.

The guide rail support assembly 300 includes a junction element 302 and a mounting element 304. The junction element 302, in this embodiment, is affixed to or connected to the mounting element 304 by a connector 306. The connector 306 may be a fixed element (e.g., rigid metal) or may be an adjustable element, such that a separation distance between the junction element 302 and the mounting element 304 may be changed or adjusted. Accordingly, in some embodiments, the specific relative position of the junction element 302 may be set relative to the mounting element 304 after installation into an elevator shaft.

The junction element 302 is configured to receive two separate rail sections, to allow connection of a first rail section and a second rail section, similar to prior junction fishplates. However, in some embodiments, fasteners may not be required. As shown, the junction element 302 has a backing plate 308, a first extension 310, a second extension 312, and a stop 314. The junction element 302 defines, in this embodiment, two rail cavities: a first rail cavity 316 and a second rail cavity 318 between the backing plate 308, the first extension 310, the second extension 312, and the stop 314. The rail cavities 316, 318 are shaped to receive a base of a rail section of a guide rail. The stop 314 is arranged to limit the extent to which a given rail section can fit into the junction element 302. In some embodiments, the rail cavities 316, 318 are sized to enable a press-fit or interference fit between the features of the junction element 302 and a rail section inserted into the rail cavities 316, 318.

The mounting element 304 of the guide rail support assembly 300 is configured to enable mounting and connection to a wall of an elevator shaft. As such, the mounting element 304 may be a plate 320 having one or more apertures for affixing the mounting element 304 to the wall. In some embodiments, the junction element 302, the mounting element 304, and the connector 306 may be integrally formed or cast, or two of the elements may be formed as a single, cast element, with the third being attached or affixed, and in some embodiments, moveable or adjustable engagement may be provided.

In the embodiments of FIGS. 3A-3B, the guide rail support assembly 300 is a single, unitary structure. That is, the junction element 302 and the mounting element 304 are a unitary body, and may be formed or cast from a single material. However, in other embodiments, one or more aspects of the guide rail support assemblies of the present disclosure may be formed from multiple separate parts that are joined or attached to make up the guide rail support assembly. For example, in one non-limiting example of a multi-part guide rail support assembly, five separate pieces may be assembled together. In one such example, a first part may be mounted to an elevator shaft wall, with this part also forming a stop. Two separate backing plates, which may be "L" shaped can then attach to the mount/stop part. Additionally, two separate extension elements, that define one or more rail cavities, as described above, may be affixed to the backing plates. This is merely for descriptive purposes, and one or more of the above described separate elements may be joined to form a unitary part (e.g., the extensions and backing plates may be unitary parts that are affixed to the mount/stop).

Figure 4A:
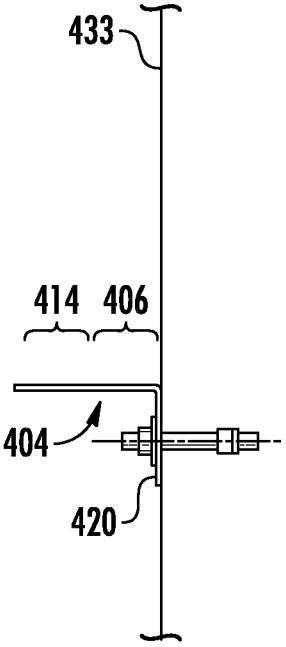
FIGS. 4A-4H are illustrative schematic views of assembly of a guide rail support assembly in accordance with an embodiment of the present disclosure.
Figure 4B:
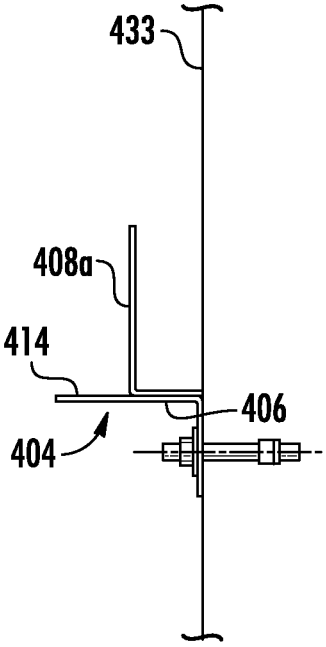
Figure 4C:
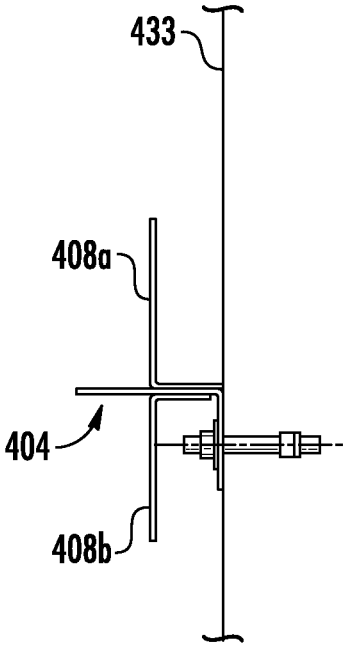
Figure 4D:
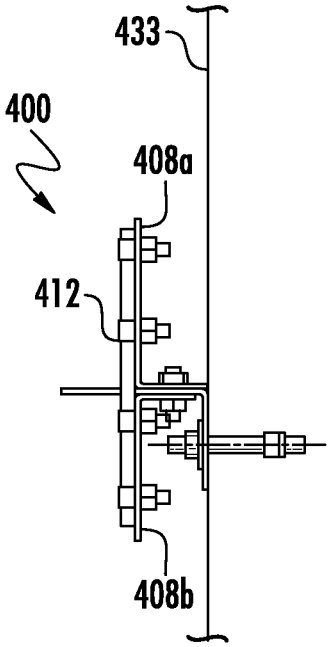
Figure 4E:
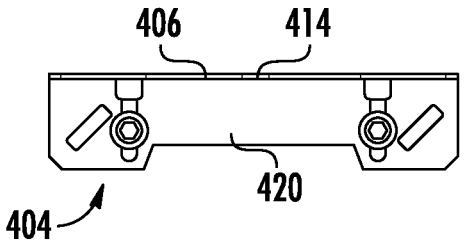
Figure 4F:
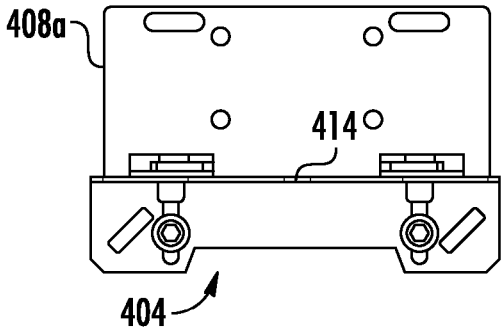
Figure 4G:
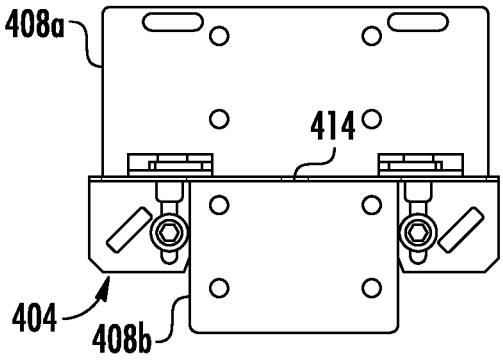
Figure 4H:
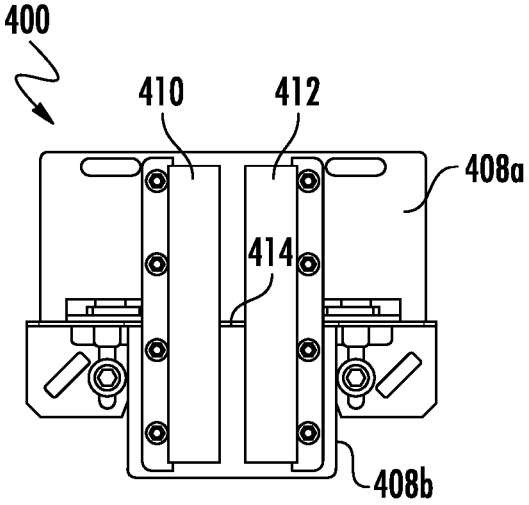

Turning now to FIGS. 4A-4H, schematic illustrations of an assembly process of a guide rail support assembly 400 in accordance with an embodiment of the present disclosure is shown. FIGS. 4A-4D are side view illustrations of the assembly process and FIGS. 4E-4H are respective front elevation views of the assembly. As such, FIG. 4A is a side elevation view of a first aspect of an assembly process, and FIG. 4E is a front elevation view of the same first aspect of the assembly process. FIGS. 4B and 4F, FIGS. 4C and 4G, and FIGS. 4D and 4H are similarly combinations of views of the assembly process illustrating side and front elevation views. FIGS. 4D and 4H illustrate the guide rail support assembly 400 as fully assembled.

FIGS. 4A and 4E illustrate a mounting element 404 as affixed to a wall 433 of an elevator shaft. As illustratively shown, the mounting element 404 is affixed to the wall 433 by a fastener. In this embodiment, the mounting element 404 includes a plate 420, a connector 406, and a stop 414. That is, in this embodiment, the mounting element 404 is arranged to provide three separate functions (i.e., mounting, placement of a junction element relative to the wall 433, and provide a stop between rail sections installed into the guide rail support assembly 400).

Turning to FIGS. 4B and 4F, a part of a junction element of the guide rail support assembly 400 is assembled to the mounting element 404. As shown, a first backing plate 408*a* is positioned relative to the mounting element 404, and, specifically, relative to the stop 414 and the connector 406.

As shown in FIGS. 4C and 4G, a second backing plate 408*b* is arranged opposite the first backing plate 408*a* relative to the mounting element 404. The first backing plate 408*a* and the second backing plate 408*b* may be fixedly attached to each other and to the mounting element 404 by one or more fasteners, as illustratively shown in FIG. 4D.

As shown in FIGS. 4D and 4H, a first extension 410 and a second extension 412 may be affixed to the first backing plate 408*a* and the second backing plate 408*b* by one or more fasteners. When the first extension 410 and the second extension 412 are attached, the guide rail support assembly 400 is assembled and able to receive and support one or more rail sections, similar to the guide rail support assembly described with respect to FIGS. 3A-3B.

Figure 5A:
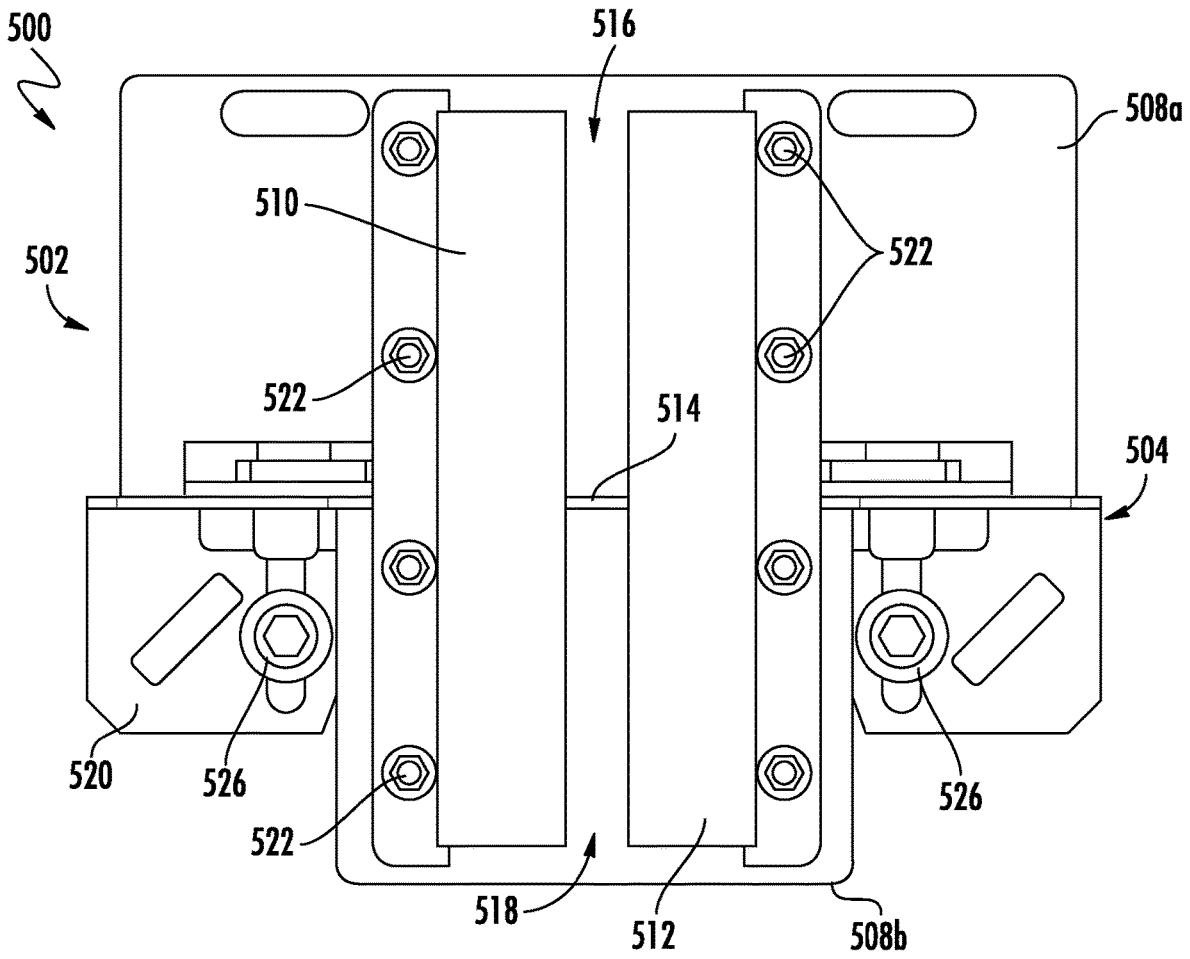
FIG. 5A is a front elevation illustration of a guide rail support assembly in accordance with an embodiment of the present disclosure.
Figure 5B:
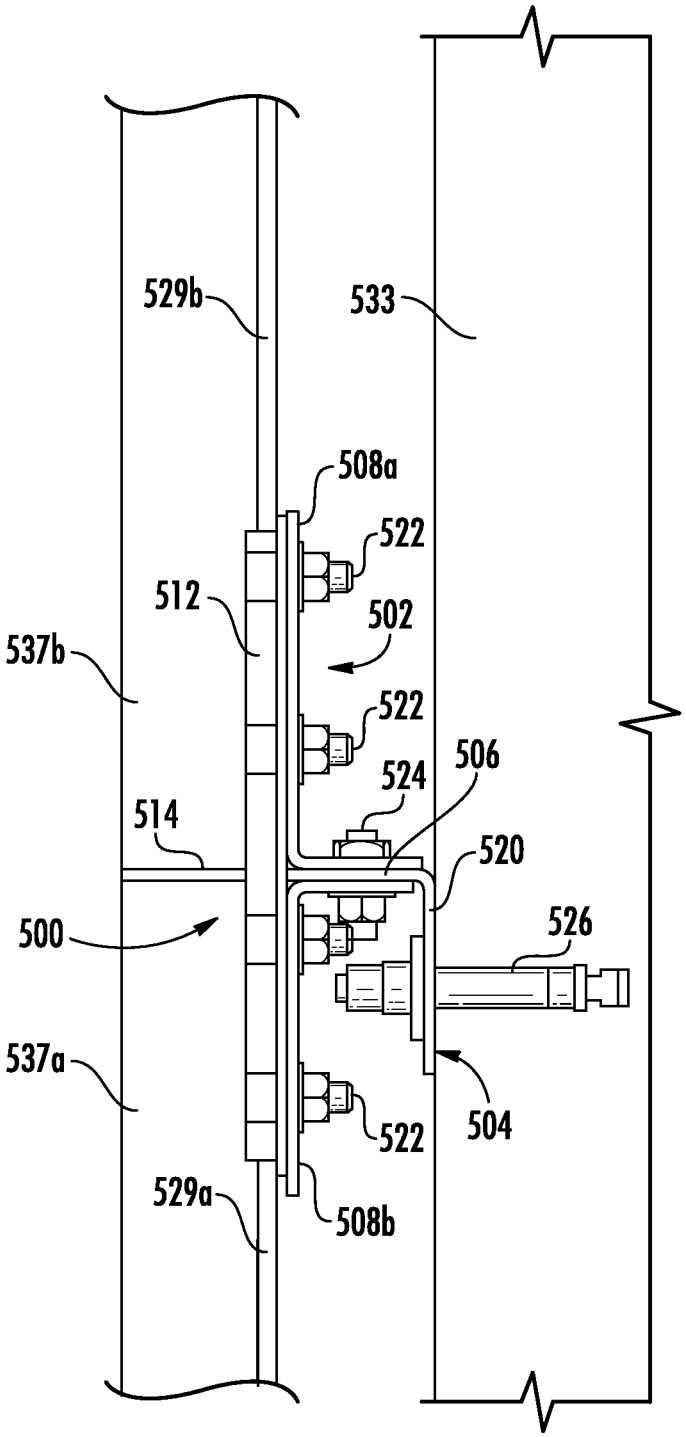
FIG. 5B is a side view illustration of the guide rail support assembly of FIG. 5A as attached to a wall and connecting rail sections of a guide rail.

Turning now to FIGS. 5A-5B, schematic illustrations of a guide rail support assembly 500 in accordance with an embodiment of the present disclosure are shown. FIG. 5A is a front elevation illustration of the guide rail support assembly 500, which may have a construction substantially similar to that shown and described with respect to FIGS. 4A-4H. FIG. 5B is a side elevation illustration of the guide rail support assembly 500 as installed to a wall 533 of an elevator shaft and joining a first rail section 537*a* and a second rail section 537*b*.

The guide rail support assembly 500 is similar to the guide rail support assembly 400 shown and described in FIGS. 4A-4H, above, and thus some features may not be described in detail again. The guide rail support assembly 500 includes a junction element 502 and a mounting element 504. The junction element 502, in this embodiment, is formed, in part, by a first backing plate 508*a* and a second backing plate 508*b* that are joined together by first fasteners 522, with a first extension 510 and a second extension 512 affixed thereto, to define one or more rail cavities, as described herein. Positioned between the first backing plate 508*a* and the second backing plate 508*b* is a connector 506 that is part of the mounting element 504, and an optional stop 514 extending from the connector 506. The stop 514 may separate the junction element 502 into two separate rail cavities, as described below. In embodiments without the stop 514, a single rail cavity is defined within the junction element 502 (e.g., as shown and described in FIG. 7). The stop 514 and the connector 506 extend from a plate 520 of the mounting element 504, as shown in FIG. 5B (and as shown in FIGS. 4A-4H). As such, the mounting element 504 includes the plate 520, the connector 506, and the stop 514 as a unitary structure. It will be appreciated that, in this embodiment, the stop 514 is a part of both the junction element 502 (defining the separate rail cavities) and the mounting element 504 (being physically part thereof).

In this embodiment, the junction element 502 defines a first rail cavity 516 and a second rail cavity 518 as described above, and shown in FIG. 5A. In this embodiment, the first rail cavity 516 is defined between the first backing plate 508*a*, parts of the first and second extensions 510, 512, and the stop 514. The second rail cavity 518 is defined between the second backing plate 508*b*, parts of the first and second extensions 510, 512, and the stop 514 (an opposite side of the stop 514 from the first rail cavity 516). During assembly, the first backing plate 508*a*, the second backing plate 508*b*, and the stop 514 of the mounting element 504 may be connected by one or more second fasteners 524 through the connector 506 and/or the stop 514. In this embodiment, one or more third fasteners 526 are provided to fixedly connect the plate 520 of the mounting element 504 to the wall 533, as shown in FIG. 5B.

When installing a guide rail in accordance with an embodiment of the present disclosure, and as shown in FIG. 5B, a rail base 529*a* of the first rail section 537*a* is inserted into the first rail cavity 516 (shown in FIG. 5A) and contacts the stop 514. Similarly, a rail base 529*b* of the second rail section 537*b* is inserted into the second rail cavity 518 (shown in FIG. 5A) and contacts the stop 514. The stop 514 may have the same shape, size, and dimensions as the first and second rail sections 537*a*, 537*b* such that the stop 514 forms a continuous guide rail when the first and second rail sections 537*a*, 537*b* are installed into or joined together by the guide rail support assembly 500.

As noted, the first fasteners 522 fixedly connect the first and second extensions 510, 512 to the first and second backing plates 508*a*, 508*b*. Further, the first fasteners 522 can enable a clamping force to be applied to the first and second extensions 510, 512 to provide secured and forced contact and support for the rail sections 537*a*, 537*b*.

As illustratively shown, there are no fasteners or extensions of material beyond the extensions 510, 512, other than the stop 514 which may have the same profile as the rail sections 537*a*, 537*b* (in a direction away from the wall 533). Accordingly, the entire assembly occupies less volume and room than prior configurations that employed a junction fishplate and bracket arrangement.

Turning now to FIGS. 6A-6D, a series of schematic illustrations of a process for guide rail construction or installation in accordance with an embodiment of the present disclosure is shown. A guide rail support assembly 600 is provided for joining, connecting, and installing a first rail section 637*a* to a second rail section 637*b*. In this illustrative embodiment, the guide rail support assembly 600 may be substantially similar in configuration as that shown and described with respect to FIGS. 4A-4H and FIGS. 5A-B.

Figure 6A:
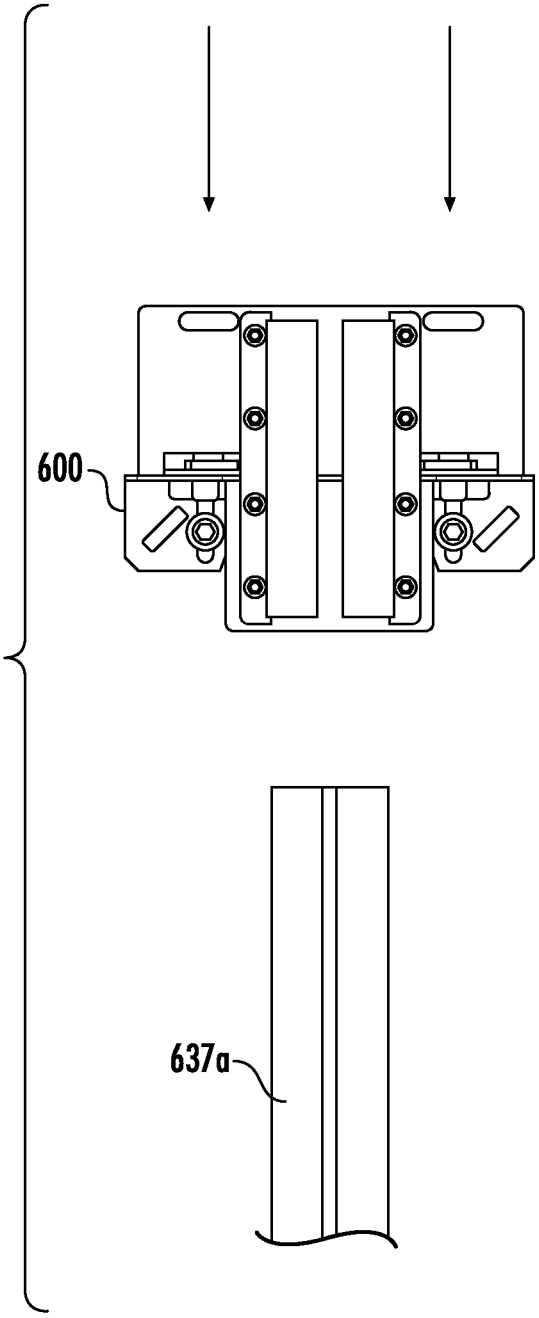
FIGS. 6A-6D are a series of schematic illustrations of an installation process of a guide rail employing a guide rail support assembly in accordance with an embodiment of the present disclosure.
Figure 6B:
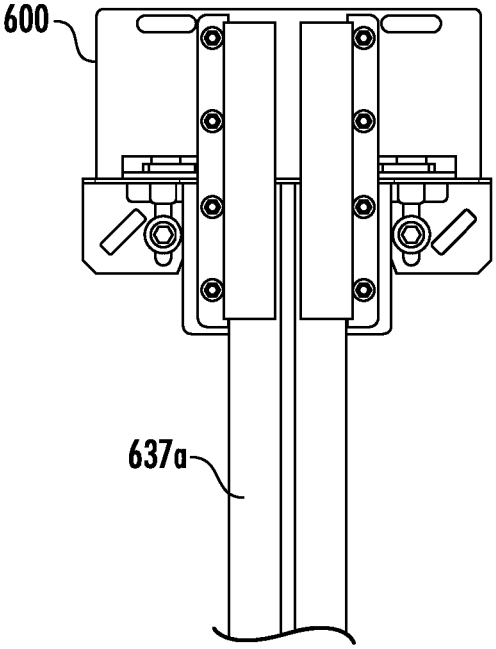

In FIGS. 6A-6B, the first rail section 637*a* is installed within an elevator shaft. The first rail section 637*a* may be a portion of a guide rail for an elevator car, counterweight, or other traveling component of an elevator system. Once installed, the guide rail support assembly 600 may be affixed to an end of the first rail section 637*a*. For example, an end of the first rail section 637*a* may be fit within a first rail cavity of the guide rail support assembly 600. One or more fasteners may be used to securely attach the guide rail support assembly 600 to the end of the first rail section 637*a*. During installation, the end of the first rail section 637*a* may contact and stop within the guide rail support assembly 600 by a stop of the guide rail support assembly 600, as described above. Further, the guide rail support assembly 600 may be fixedly connected or attached to a wall of an elevator shaft, thus fixing the first rail section 637*a* in position.

Figure 6C:
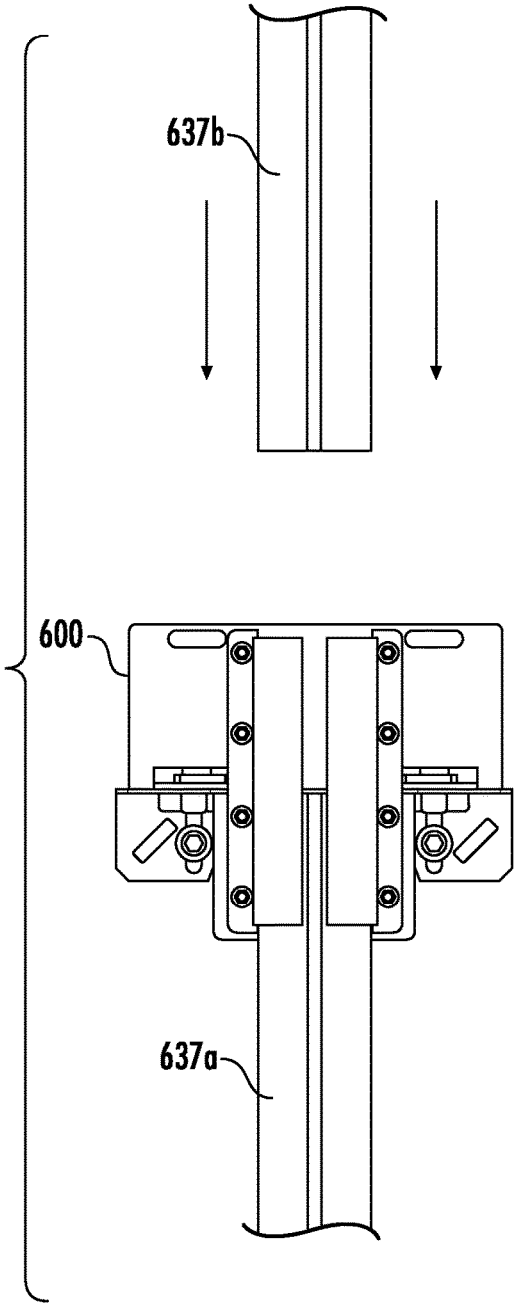
Figure 6D:
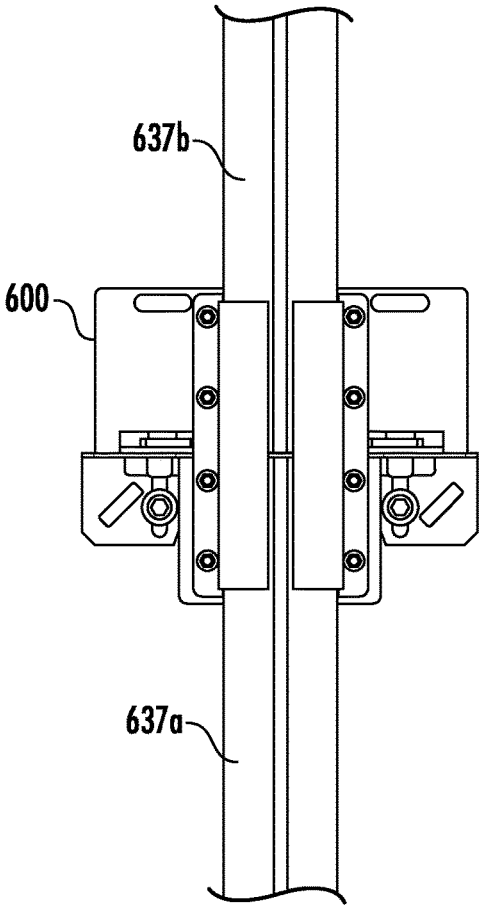

As shown in FIGS. 6C-6D, the second rail section 637*b* may be installed into a second rail cavity of the guide rail support assembly 600. Respective fasteners may be tightened to secure the second rail section 637*b* within the guide rail support assembly 600. Accordingly, the functionality of a junction fishplate and a wall bracket may be provided in a single component (e.g., guide rail support assembly 600), thus increasing installation efficiency and reducing the volume which such components occupy. It will be appreciated that in some embodiments, the fasteners that are used to secure the rail sections within the rail cavities may be omitted. In some embodiment, a press-fit or interference fit may be employed. Further still, in some embodiment, such pressed engagement may be completely omitted, wherein the ends of the rail sections slide into the rail cavities, but no additional clamping or other engagement is necessary to securely support and hold the respective rail sections.

Figure 7:
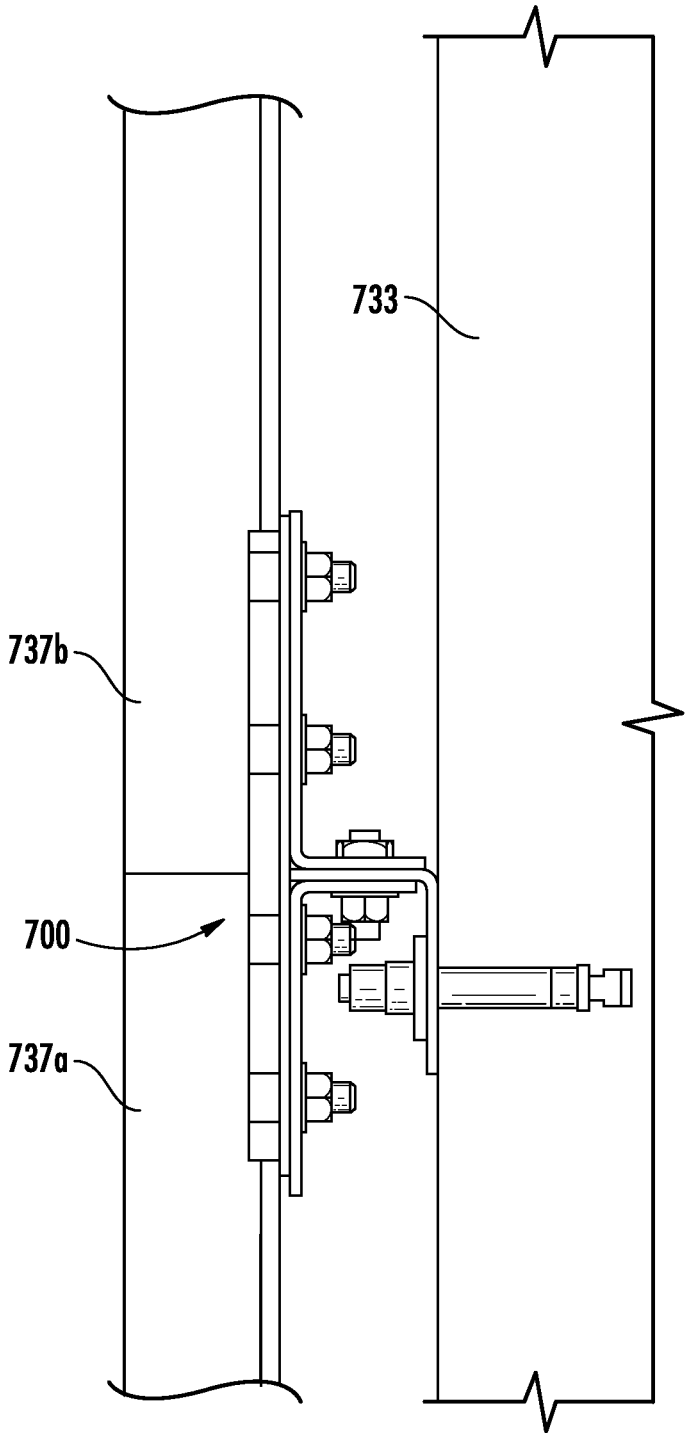
FIG. 7 is a side view illustration of a guide rail support assembly in accordance with an embodiment of the present disclosure as attached to a wall and connecting rail sections of a guide rail.

Turning now to FIG. 7, a schematic illustration of an assembly 700 in accordance with an embodiment of the present disclosure are shown. FIG. 7 is a side elevation illustration of the guide rail support assembly 700 as installed to a wall 733 of an elevator shaft and joining a first rail section 737*a* and a second rail section 737*b*. The guide rail support assembly 700 has a construction substantially similar to that shown and described with respect to FIGS. 5A-5B, and as illustratively shown in FIG. 5B. The primary difference between the guide rail support assembly 500 and the guide rail support assembly 700 of FIG. 7 is that the guide rail support assembly 700 does not include a stop. That is, the stop, described above, is an optional feature of the guide rail support assemblies of the present disclosure. Accordingly, a junction element of the guide rail support assembly 700 defines a single rail cavity that can receive ends of two different rail sections.

In this embodiment, the first rail section 737*a* and the second rail section 737*b* may abut or contact each other within the rail cavity of the guide rail support assembly 700. In some embodiments, the first rail section 737*a* and the second rail section 737*b* may have a mortise and tenon joint configuration. Still, in other embodiments, keyway or slot configurations may be implemented. That is, various alternative mechanisms for aligning and joining the rail sections within a guide rail support assembly of the present disclosure may be implemented without departing from the scope of the present disclosure.

As shown in FIGS. 4A-7, the backing plates each have different shapes and sizes. The specific shape and sizes of the backing plates may be selected for a particular project or installation, and thus the illustrative shapes and sizes are merely for example only. In some embodiments, the shape and size of the backing plates may be substantially similar or the same, such that they may be interchangeable.

Advantageously, embodiments provided herein enable dual functionality within a single structure. That is, guide rail support assemblies of the present disclosure provide both wall-attachment (mounting bracket) and rail section joining (junction fishplate) within a single component. As such, efficiencies in installation of guide rails may be achieved. Further, such systems can eliminate fasteners associated with a junction fishplate, thus reducing the volume occupied by such features.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A guide rail support assembly for an elevator system comprising:

a junction element comprising a first backing plate, a second backing plate, a first extension, and a second extension, the junction element defining a rail cavity, wherein the rail cavity is configured to receive two rail sections, wherein the junction element is configured to join a first rail section to a second rail section;

a mounting element configured to attach to a wall of an elevator shaft, wherein the mounting element is connected to the junction element;

a connector connecting the junction element to the mounting element with a stop extending from the connector, wherein the first backing plate is arranged on a first side of the stop and the second backing plate is arranged on a second side of the stop opposite from the first backing plate, and wherein the stop is configured to divide the rail cavity into a first rail cavity and a second rail cavity, wherein the stop, the first backing plate, the first extension, and the second extension define the first rail cavity, and the stop, the second backing plate, the first extension, and the second extension define the second rail cavity, wherein the first rail cavity and the second rail cavity are defined on opposite sides of the stop, wherein:

the first extension and the second extension are each connected to the first and second backing plates by first fasteners, the first backing plate and the second backing plate are connected to the connector by second fasteners, and the first fasteners are configured to apply a clamping force to the first and second extensions to secure and force contact and support for the first rail section and the second rail section arranged within the first and second rail cavities, respectively.

2. The guide rail support assembly of claim 1, wherein the connector is adjustable to adjust a separation distance between the junction element and the mounting element.

3. The guide rail support assembly of claim 1, wherein the stop has a profile in a shape of a cross-section of a rail section.

4. The guide rail support assembly of claim 3, wherein the stop is part of the mounting element.

5. The guide rail support assembly of claim 1, wherein the stop is part of the mounting element.

6. The guide rail support assembly of claim 1, wherein each of the first backing plate and the second backing plate are attached to the mounting element.

7. The guide rail support assembly of claim 6, wherein the first extension is connected to the first backing plate and the second extension is connected to the second backing plate.

8. The guide rail support assembly of claim 7, wherein each of the first and second backing plates are connected to the mounting element.

9. The guide rail support assembly of claim 6, wherein each of the first and second backing plates are connected to the mounting element.

10. The guide rail support assembly of claim 1, wherein the mounting element is connectable to a wall of an elevator shaft by at least one third fastener.

11. An elevator system comprising:

a guide rail support assembly comprising:

a junction element comprising a first backing plate, a second backing plate, a first extension, and a second extension, the junction element defining a rail cavity, wherein the rail cavity is configured to receive two rail sections, wherein the junction element is configured to join a first rail section to a second rail section;

a mounting element configured to attach to a wall of an elevator shaft, wherein the mounting element is connected to the junction element; and a connector connecting the junction element to the mounting element with a stop extending from the connector, the stop dividing the rail cavity into a first rail cavity and a second rail cavity, wherein the stop, the first backing plate, the first extension, and the second extension define the first rail cavity, and the stop, the second backing plate, the first extension, and the second extension define the second rail cavity, wherein:

the first extension and the second extension are each connected to the first and second backing plates by first fasteners, the first backing plate and the second backing plate are connected to the connector by second fasteners, and the first fasteners are configured to apply a clamping force to the first and second extensions to secure and force contact and support for the first rail section and the second rail section arranged within the first and second rail cavities, respectively.

12. The elevator system of claim 11, further comprising a first rail section installed into the first rail cavity and a second rail section installed into the second rail cavity to form a portion of a guide rail.

13. The elevator system of claim 12, wherein the guide rail is one of a guide rail for an elevator car and a guide rail for a counterweight.

14. The elevator system of claim 11, wherein the mounting element is fixedly attached to a wall of an elevator shaft.

15. The elevator system of claim 11, wherein the connector is adjustable to adjust a separation distance between the junction element and the mounting element.

16. The elevator system of claim 12, wherein the stop has a profile in a shape of a cross-section of a rail section of the guide rail.

17. The elevator system of claim 11, wherein each of the first backing plate and the second backing plate are attached to the mounting element.

18. The guide rail support assembly of claim 11, wherein the mounting element is connectable to a wall of an elevator shaft by at least one third fastener.

* * * * *